US008286825B2

(12) United States Patent
Billado, Jr.

(10) Patent No.: US 8,286,825 B2
(45) Date of Patent: Oct. 16, 2012

(54) HAND-HELD PAINT TRAY

(76) Inventor: Harry S. Billado, Jr., Newbury, NH (US)

( * ) Notice: Subject to any disclaimer, the term of this patent is extended or adjusted under 35 U.S.C. 154(b) by 194 days.

(21) Appl. No.: 12/614,837

(22) Filed: Nov. 9, 2009

(65) Prior Publication Data

US 2010/0140275 A1 Jun. 10, 2010

Related U.S. Application Data

(60) Provisional application No. 61/112,344, filed on Nov. 7, 2008.

(51) Int. Cl.
*B65D 25/32* (2006.01)

(52) U.S. Cl. ..... 220/773; 220/762; 220/764

(58) Field of Classification Search ..... 220/773, 220/762, 763, 764, 766, 570
See application file for complete search history.

(56) References Cited

U.S. PATENT DOCUMENTS

| | | | | |
|---|---|---|---|---|
| 4,399,926 | A * | 8/1983 | Eidels-Dubovoy | 220/288 |
| 5,511,279 | A * | 4/1996 | Ippolito | 15/257.06 |
| D460,845 | S | 7/2002 | Bergman | |
| 6,708,838 | B2 | 3/2004 | Bergman et al. | |
| 6,991,829 | B2 | 1/2006 | Bergman | |
| 7,191,913 | B2 | 3/2007 | Byrne | |
| D549,913 | S | 8/2007 | Bergman | |
| 2006/0243732 | A1 * | 11/2006 | Bergman | 220/757 |
| 2007/0151975 | A1 | 7/2007 | Billado, Jr. | |
| 2009/0032542 | A1 | 2/2009 | Temple | |

FOREIGN PATENT DOCUMENTS

GB 2095214 A * 9/1982

OTHER PUBLICATIONS

Product Catalog by Encore Plastics Corporation, Sandusky, Ohio.
Acehardwaresuperstore.com; Paintin Pal Touch-Up Palm; Model 1219765, Manf# 82102, UPC#098262821020, Manufactured by Encore Plastics; printed on Nov. 5, 2009.

* cited by examiner

*Primary Examiner* — Stephen Castellano
(74) *Attorney, Agent, or Firm* — Grossman, Tucker, Perreault & Pfleger, PLLC

(57) ABSTRACT

A hand-held paint tray including a body portion and a generally u-shaped handle. The handle includes first and second side portions and a connecting portion extending between the first and second side portions. The first and second side portions arc upwardly from the connecting portion and are connected to opposed side walls of the body.

9 Claims, 2 Drawing Sheets

HAND-HELD PAINT TRAY

CROSS-REFERENCE TO RELATED APPLICATIONS

This application claims the benefit of the filing date of U.S. Provisional Application Ser. No. 61/112,344, filed Nov. 7, 2008, the teachings of which are hereby incorporated herein by reference

FIELD

This present disclosure relates generally to paint tray assemblies and paint kits, more specifically to a hand-held wet architectural coating and wet coating applicator storage container, dry storage container, and dry package assembly for paint tray assemblies or paint kits.

BACKGROUND

In conventional use of a paint tray or container, a batch of paint from a one gallon or other convenient sized container of paint may be poured into a tray which usually has a storage capacity considerably less than the volume of the paint container, and the roller sleeve and/or paint brush may be dipped into the tray as the work progresses until the batch is exhausted, at which time another batch of paint may be poured into the tray. Known hand-held paint trays may be unstable, presenting the possibility of spillage, and/or may be difficult or cumbersome to grip and hold for long periods of time.

SUMMARY

In a paint tray or container consistent with the present disclosure, a strap or handle may be attached to the tray body for easy handling of the tray with one hand. This may allow for an improvement in painting quality, particularly for trim applications, as one does not have to pick up and put down the tray each time a new section is to be painted. In addition, the handle may be configured substantially horizontally in an ergonomic manner to fit the hand and forearm such that little fatigue may be experienced even after longer sessions of painting. More specifically, the strap may be curved in a manner to fit the back of the hand while allowing the weight of the tray to be placed on one's fingertips and allow a space between the palm of the hand and the rear of the tray. This may allow the arm to be maintained in a resting position and reduce the possibility of spilling paint while maneuvering the tray. In addition, the strap may have a plurality of attachment positions on each side of the tray for length adjustment to fit various sizes of hands.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION

Figure 1:
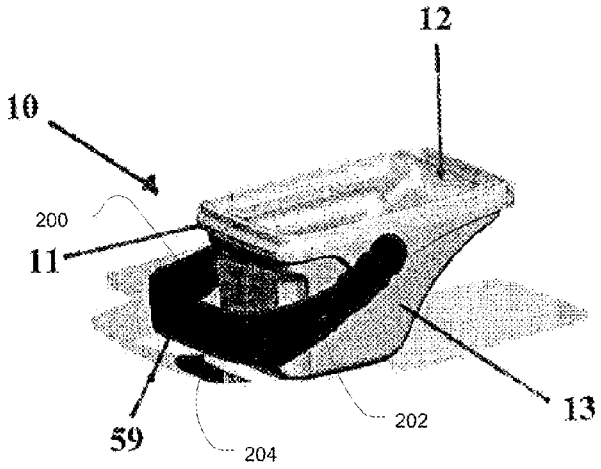
FIG. 1 is a perspective view of a paint kit consistent with the disclosure, the paint kit including a sealable tray assembly consisting of a separate lid which may be assembled to a tray body and a handle or strap for holding the tray in one hand.

In the following description of a specific embodiment, like reference numerals will be used to refer to like or similar parts from Figure to Figure in the drawings. For convenience of description, reference will hereafter be made to "paint" as representative generally of architectural coatings. References will hereafter be made to "paint kit" as representative generally of a paint tray, lid and paint applicator such as a roller assembly.

Referring first to FIG. 1, one exemplary embodiment of a hand-held paint tray consistent with the present disclosure is illustrated generally at 10 in an assembled condition. The paint kit 10 includes a tray assembly indicated generally at 11, the tray assembly consisting of a lid indicated generally at 12 and a tray body indicated generally at 13. In FIG. 1 the lid and tray are shown in an assembled condition, such as to store an applicator and prevent evaporation of paint solvents and, as such, the lid and tray are shown sealed.

Figure 2:
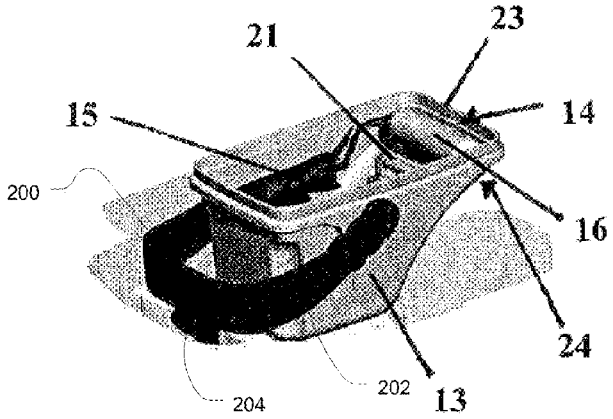
FIG. 2 is a perspective view of the sealable tray assembly of FIG. 1 with the lid removed showing the storage of a mini roller.

In FIG. 2 the lid 12 has been removed to show the storage of a paint applicator, indicated generally at 14, here a mini roller assembly. The mini roller assembly 14 may include a handle 15 and a sleeve portion 16. A generally vertically disposed portion of the front wall is indicated at 23, wherein the wall portion 23 desirably flanks a concave section 24 at the top of an inclined ramp portion 21 of the bottom 20 of the body. The concave section extends parallel to the front wall and generally conforms to roller sleeve portion 16, of roller assembly 14. The mini roller assembly 14 as shown may be positively located with the sleeve portion 16 residing in the concave portion 24 adjacent the front wall of the tray body 13 and the handle residing in a U-shaped rest 31 (see FIG. 4) such that when the tray is sealed by the lid the mini roller is retained within the tray in a stationary position.

Figure 3:
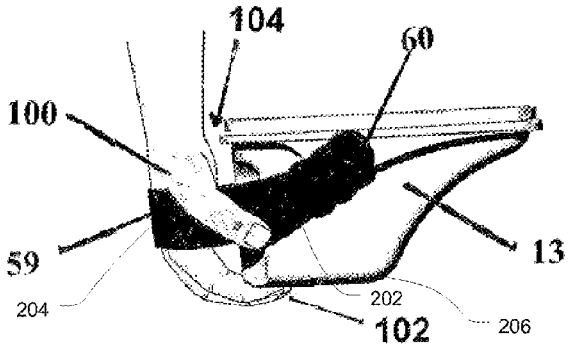
FIG. 3 is a side view of the tray body as shown in FIG. 1, illustrating how the tray may be carried in one hand.

FIG. 3 illustrates the tray body 13 in a use position, held by one hand 100, wherein the strap or handle 59 is configured to allow a hand 100 to be positioned between the handle and the rear wall of the tray body in an ergonomic position to easily support the tray body containing paint, and allow freedom of the opposite hand for applying the paint with the mini roller or another applicator. The strap or handle 59 may be a rigid plastic component and may be generally u-shaped having a first 200 and second 202 arm portions and a connecting portion 204. The first and second arm portions may be coupled to opposing sides of the tray by one or more buttons 60, each button 60 having an aperture which may engage projections (not shown) on each side 18, 19 of the tray to allow length adjustment to fit various size hands. The connecting portion may be generally flat and may have a width of at least about 0.5" for comfortably contacting the back of a user's hand. The arm portions 200, 202 may arc upwardly (as shown in FIG. 3) from the connecting portion204, generally in a direction away from the bottom wall 20 of the paint tray when the handle is coupled thereto. The arm portions may progressively narrow in width from the connection portion to the ends thereof that are connected to the opposed sides of the body. This configuration allows the arm to be placed in a fully-extended resting position when carrying the tray containing paint with the paint tray in a position which will avoid spillage of paint from the interior of the tray.

As shown in FIG. 3, in a tray consistent with the present disclosure the fingertips 102 of the hand 100 may contact and support the bottom of the tray body while the connecting portion of the strap or handle 59 contacts the back of the hand 100 to support the tray body 13 in a cantilevered manner. This may allow a space 104 to be formed between the tray body and the palm of the hand, allowing the hand to remain in a relatively relaxed position. The arcing/curved feature of the arm portions of the handle further enhances the ergonomic positioning of the tray in the hand and in locating the tray on the fingertips. These features may provide less fatigue after holding the tray containing paint for extended periods of time.

Figure 4:
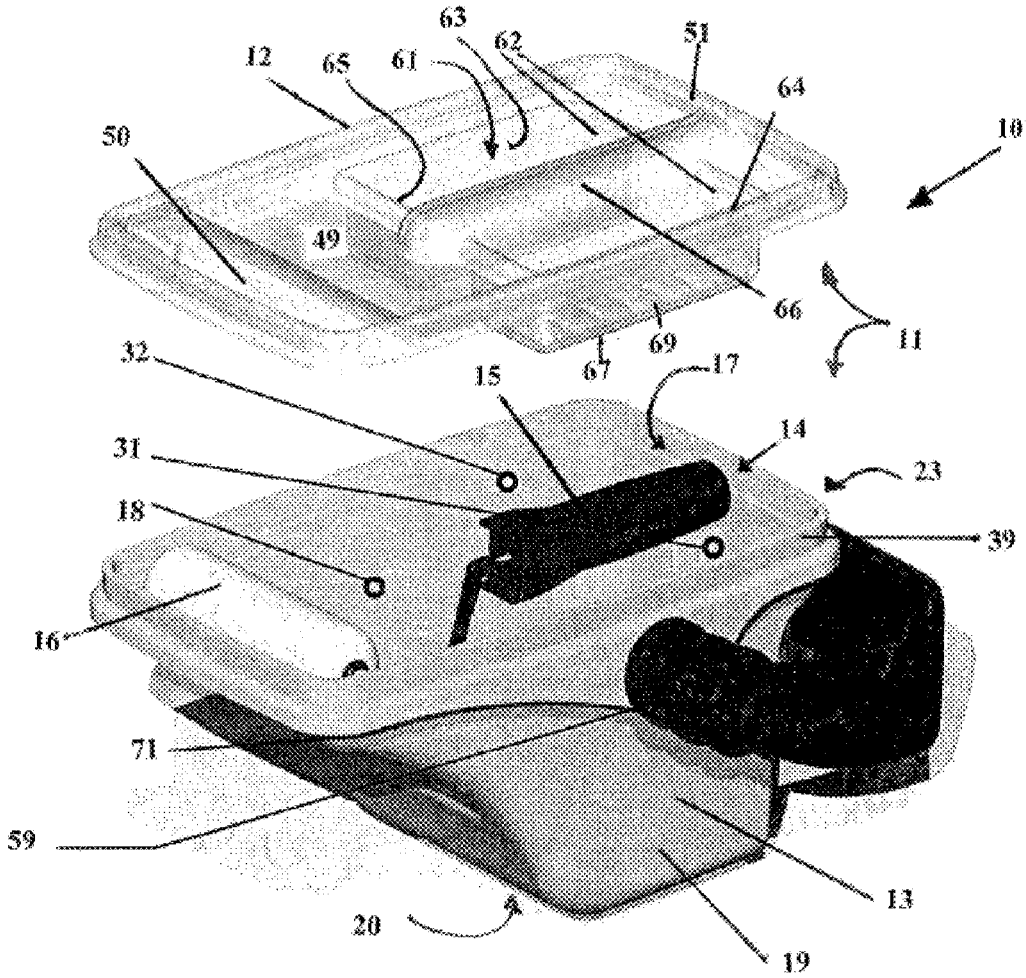
FIG. 4 is an exploded view of FIG. 1 showing the lid separated from the tray as well as some of the interior features of the tray body and a mini roller assembly properly placed in the internal applicator rest and concaved section of inclined ramp.

FIG. 4 is a perspective view of the paint kit 10 in an exploded view. Tray body 13 of tray assembly 11 may include rear wall 17, left wall 18 and a right wall 19 extending upwardly from a bottom wall 20 to define a reservoir, e.g. for receiving paint. The upper peripheral co-planer edges of rear wall 17, left and right side walls 18 and 19 and front wall 23, may terminate in an outwardly projecting flange 39. The bottom may include an incline ramp 21 portion (see FIG. 2) adjacent the front end of the tray body.

An interior applicator rest 31, formed generally in a U-shape, or similar upwardly opening protrusion may be disposed extending inwardly from interior of wall 17. Roller assembly handle 15 may rest in applicator rest 31 when roller assembly is not in use. The floor of the inclined ramp 21 (see FIG. 2) is preferably provided with a plurality of ribs and a pair of paint draining channels (not shown) arranged on either side of the ribs for removing excess paint from the roller sleeve portion 16 in a conventional manner.

As indicated at 32, one or more magnets may be molded into the walls of the tray body 13 to position and retain other paint applicators, such as brushes or pads, in the tray for storage between applications.

The compact hand-held paint tray assembly may be formed of metal or plastic, preferably of a relatively low cost, relatively low weight and relatively inert material such as a polyolefin, for instance, polypropylene or polyethylene.

As further shown in FIG. 4, lid 12 includes a flat portion 49, which surrounds a convex section indicated generally at 50 near the front end of lid. The convex section 50 may be formed as an upwardly and outwardly protruding hemi-cylindrical section. Flat portion 49 preferably terminates at a trough indicated generally at 61 near the rear end of lid 12. The trough 61 may be formed by downwardly and inwardly inclined rear wall 62, left and right downwardly and inwardly inclined side walls 63, 64, respectively, and a front wall indicated generally at 65. Front wall 65 and rear wall 62, may be connected by a convex section 66 that may divide the bottom wall into two equal halves. The outer peripheral co-planer edges of rear wall 62, left and right side walls 63 and 64 and flat portion 49, terminate in an outwardly projecting flange 51. The outwardly projecting flange 39 of tray body 13 may mate with the outwardly projecting flange 51 of lid 12 to seal the paint kit 10.

As best seen in FIGS. 2 and 4 the tray body 13 may be dimensioned to entirely receive the mini roller assembly 14 within the cavity formed in tray body 13, such that the roller sleeve portion 16 may be generally received at 71, and the roller handle 15 generally received in the interior U-shaped applicator rest 31 extending inwardly from the interior wall 17. In one embodiment, for example, the tray body and the lid may be configured as described in Published U.S. Patent Application Ser. No. 2007/0151975, the teachings of which are hereby incorporated herein by reference. The roller assembly 14 may remain sufficiently above the surface of the inclined plane 21 to prevent contact therewith, or contamination with any paint thereon. The lid's convex section 50 in conjunction with concave section 71, preferably blends smoothly into tray body 13 and with U-shaped applicator rest 31 fixed on the interior of wall 17, acts as a stationary abutment to block movement of the roller assembly 14. The length of the roller assembly with respect to the distance between front wall 23 and rear wall 17, may be so dimensioned that the roller assembly 14 may be locked into the position with only slight variation, in all angular orientations of the paint kit 10 with respect to the vertical; i.e., from the vertical position of FIGS. 1 and 4 to a position ninety degrees tilted with respect thereto and all angles there between.

Thus, whether the paint kit 10 is displayed for purchase in the vertical position or in a horizontal position ninety degrees removed from that position, the paint applicator 14 may generally retain its same relative position with respect to the tray assembly 11, and hence an orderly, eye-pleasing appearance of the paint kit 10 may always be presented to the retail customer. It will be understood, of course, that the width of any paint applicator, such as the mini roller assembly 14 used in the above described fashion, may be slightly less than the inside dimension of the two walls 17, 23. Such slight clearance may not be sufficient however to permit any paint applicator, such as a paint roller assembly 14 to become skewed with respect to the paint tray assembly 11 so that the orderly appearance of the paint kit 10 may be maintained at all times.

The lid 12 may be inverted to provide additional features of the paint kit according to the present disclosure. The lid 12 may include bottom wall 67 which may be provided with a plurality of ribs 69 for removing any excess paint from paint pads and the inverse of convex section 66 of the lid 12, now a concaved section, may be used, for example, to hold an additional mini paint roller assembly. Similarly, the underside of section 50 of lid 12 can now be used to rest an additional roller assembly if necessary, while the tray assembly is in use.

In the illustrated exemplary embodiment, since a good seal may be formed between the lid 12 and tray body 13 the two parts may function as a sealed container for holding paint and a paint applicator, such as a mini roller assembly 14 between uses of the paint kit 10. Thus, should the user not be able to complete a project and be forced to terminate work before the paint stored in tray body 13 is used, the lid 12 may be snapped onto the tray body 13 and the paint and roller assembly 14 may be left overnight or longer with a lessened degree of solvent evaporation and the emissions of volatile organic compounds inherent in paint into the environment, and the consequent formation of a skin on the paint and the hardening of paint on the paint applicator when the paint kit 10 is not in use.

According to one aspect of the disclosure therefore, there is provided a hand-held paint tray including: a body portion including a bottom and a rear wall, front wall, left side wall, and right side wall extending upwardly from the bottom to define a reservoir; and a generally u-shaped handle including first and second side portions and a connecting portion extending between the first and second side portions, the first and second side portions arcing upwardly from the connecting portion and being connected to the left side wall and the right side wall, respectively, whereby the connecting portion may be positioned adjacent to and spaced from the rear wall so that a user's hand may extend between the connecting portion and the rear wall with the connecting portion contacting a back of the user's hand and fingers of the user's hands contacting the bottom for supporting the paint tray during use.

According to another aspect of the disclosure, there is provided a hand-held paint tray including: a body portion including a bottom and a rear wall, front wall, left side wall, and right side wall extending upwardly from the bottom to define a reservoir, the rear wall, the front wall, the left side wall and the right side wall terminating in co-planar edges, the bottom portion including an incline ramp portion, and a concave section at the top of the incline ramp portion extending parallel to the front wall, the concave region generally conforming to the sleeve portion of the paint roller; an applicator rest extending inwardly from the rear wall, the applicator rest being dimensioned to support a handle portion of a paint roller with sleeve portion of the paint roller disposed in the concave region; a lid configured to releasably engage the co-planar edges to seal paint and the paint roller within the paint tray; a rigid and generally u-shaped handle including first and second side portions and a connecting portion extending between the first and second side portions, the first and second side portions arcing upwardly from the connecting portion and being connected to the left side wall and the right side wall, respectively, whereby the connecting portion may be positioned adjacent to and spaced from the rear wall so that a user's hand may extend between the connecting portion and the rear wall with the connecting portion contacting a back of the user's hand and fingers of the user's hands contacting the bottom for supporting the paint tray during use Thus, there has been disclosed a hand-held paint tray, capable of being held in one hand. Although a specific embodiment of the invention has been illustrated and described it will be appreciated from the foregoing description that modifications may be made without departing from the spirit and scope of the invention. Accordingly it is intended that the scope of the invention be limited solely by the scope of the hereafter appended claims when interpreted in light of the relevant prior art, and not by limitations set out in the foregoing specification.

What is claimed is:

1. A hand-held paint tray comprising:

a body portion comprising a bottom and a rear wall, front wall, left side wall, and right side wall extending upwardly from said bottom to define a reservoir; and a generally u-shaped handle comprising first and second side portions and a connecting portion extending between said first and second side portions, said first and second side portions being connected to said left side wall and said right side wall, respectively, at ends of said first and said second side portions and said connecting portion being positioned adjacent to and spaced from said rear wall, said ends of said first and second side portions define one or more apertures configured to receive one or more projections defined on said left and right side walls and allow length adjustment of said handle relative to said body portion, wherein said first and second side portions arc upwardly from said connecting portion and in a direction away from said bottom of said body portion when said first and second side portions are connected to said left and right side walls, respectively, so that a user's hand may extend between said connecting portion and said rear wall with said connecting portion contacting a back of said user's hand and fingers of said user's hand contacting said bottom for supporting said paint tray during use.

2. A paint tray according to claim 1, wherein said first and second side portions of said handle progressively narrow from said connecting portion of said handle to ends of said first and second side portions connected to said left and right side walls, respectively.

3. A paint tray according to claim 1, wherein said front wall, said rear wall and said left and right side walls terminate in co-planar edges and wherein said paint tray further comprises a lid configured to releasably engage said co-planar edges to seal paint within said paint tray.

4. A paint tray according to claim 1, wherein said paint tray further comprises an applicator rest extending inwardly from said rear wall, said applicator rest being dimensioned to support a handle portion of a paint roller with a sleeve portion of said paint roller supported adjacent said front wall.

5. A paint tray according to claim 4, wherein said front wall, said rear wall and said left and right side walls terminate in co-planar edges and wherein said paint tray further comprises a lid configured to releasably engage said co-planar edges to seal paint and said paint roller within said paint tray.

6. A paint tray according to claim 1, wherein said bottom includes an incline ramp portion.

7. A paint tray according to claim 6, wherein said bottom includes a concave section at the top of said incline ramp portion and extending parallel to said front wall, said concave section being dimensioned to conform to a sleeve portion of a paint roller.

8. A hand-held paint tray comprising:

a body portion comprising a bottom and a rear wall, front wall, left side wall, and right side wall extending upwardly from said bottom to define a reservoir, said rear wall, said front wall, said left side wall and said right side wall terminating in co-planar edges, said bottom portion including an incline ramp portion, and a concave section at the top of said incline ramp portion extending parallel to said front wall, said concave section being dimensioned to conform to a sleeve portion of a paint roller;

an applicator rest extending inwardly from said rear wall, said applicator rest being dimensioned to support a handle portion of said paint roller with said sleeve portion of said paint roller disposed in said concave section;

a lid configured to releasably engage said co-planar edges to seal paint and said paint roller within said paint tray;

a rigid and generally u-shaped handle comprising first and second side portions and a connecting portion extending between said first and second side portions, said first and second side portions being connected to said left side wall and said right side wall, respectively, at ends of said first and said second side portions and said connecting portion being positioned adjacent to and spaced from said rear wall, said ends of said first and second side portions define one or more apertures configured to receive one or more projections defined on said left and right side walls and allow length adjustment of said handle relative to said body portion, wherein said first and second side portions arc upwardly from said connecting portion and in a direction away from said bottom of said body portion when said first and second side portions are connected to said left and right side walls, respectively, so that a user's hand may extend between said connecting portion and said rear wall with said connecting portion contacting a back of said user's hand and fingers of said user's hand contacting said bottom for supporting said paint tray during use.

9. A paint tray according to claim 8, wherein said first and second side portions of said handle progressively narrow from said connecting portion of said handle to ends of said first and second side portions connected to said left and right side walls, respectively.

* * * * *